US006173945B1

(12) United States Patent
Lindsey et al.

(10) Patent No.: US 6,173,945 B1
(45) Date of Patent: Jan. 16, 2001

(54) METAL FENCE POST

(75) Inventors: Michael Lindsey, Ontario; Charlie Larsen, Huntington Beach, both of CA (US); Jerry L. Short, Washougal, WA (US)

(73) Assignee: Master-Halco, Inc., La Habra, CA (US)

( * ) Notice: Under 35 U.S.C. 154(b), the term of this patent shall be extended for 0 days.

(21) Appl. No.: 09/128,287

(22) Filed: Aug. 3, 1998

(51) Int. Cl.[7] ..... E04H 17/16; E04H 17/14

(52) U.S. Cl. ..... 256/24; 256/21; 256/59; 256/65; 256/DIG. 5

(58) Field of Search ..... 256/24, 25, 21, 256/59, 65, 68, DIG. 5

(56) References Cited

U.S. PATENT DOCUMENTS

| | | | | |
|---|---|---|---|---|
| 10,781 | * | 4/1854 | Coons | 256/21 X |
| 40,574 | * | 11/1863 | Ross | 256/24 |
| 124,502 | * | 3/1872 | McKnight | 256/24 |
| 131,038 | | 9/1872 | Sprout . | |
| 196,175 | * | 10/1877 | Willcuts | 256/DIG. 5 |
| 200,645 | * | 2/1878 | Densmore | 256/24 |
| 416,353 | * | 12/1889 | Barnes | 256/59 |
| 492,876 | * | 3/1893 | Rosback et al. | 256/68 |
| 772,662 | * | 10/1904 | Mallory | 256/21 X |
| 891,466 | | 6/1908 | Dewey . | |
| 1,517,119 | * | 11/1924 | Luhring | 256/DIG. 5 X |
| 1,701,670 | * | 2/1929 | Feldman | 256/25 |
| 2,150,291 | | 3/1939 | Paque . | |
| 2,227,553 | | 1/1941 | Paque . | |
| 2,842,344 | * | 7/1958 | Todd | 256/21 |
| 2,932,488 | * | 4/1960 | Dotson | 256/21 |
| 3,099,247 | * | 7/1963 | Bieber | 256/21 X |
| 3,269,553 | * | 8/1966 | Ruhnke | 256/65 X |
| 3,524,627 | * | 8/1970 | Boyanton et al. | 256/65 |
| 3,615,110 | * | 10/1971 | Fugate | 256/59 |
| 3,669,480 | * | 6/1972 | Fugate | 256/65 X |
| 3,863,900 | * | 2/1975 | Dagiel et al. | 256/59 |
| 4,007,919 | * | 2/1977 | Totten | 256/59 |
| 4,119,302 | | 10/1978 | Moroco et al. | 256/48 |
| 4,132,390 | * | 1/1979 | Pfarr, Jr. | 256/24 |
| 4,369,953 | * | 1/1983 | Greiner et al. | 256/24 |
| 4,386,762 | * | 6/1983 | Collins | 52/297 X |
| 4,542,885 | | 9/1985 | Rossiter | 256/69 |
| 4,616,950 | * | 10/1986 | Morris | 256/65 X |
| 4,899,991 | * | 2/1990 | Brunkan | 256/24 X |
| 4,973,110 | * | 11/1990 | Nyquist | 403/252 X |
| 4,995,590 | * | 2/1991 | Close | 256/24 |
| 5,160,211 | * | 11/1992 | Gilb | 256/65 X |
| 5,297,890 | | 3/1994 | Commins | 403/398 |
| 5,716,041 | * | 2/1998 | Groves | 256/24 X |
| 5,913,508 | * | 6/1999 | Eades | 256/59 X |

FOREIGN PATENT DOCUMENTS

| | | | | |
|---|---|---|---|---|
| 2600698 | * | 2/1984 | (FR) | 256/DIG. 5 |
| 2129845 | | 5/1984 | (GB) . | |

* cited by examiner

*Primary Examiner*—Lynne H. Browne
*Assistant Examiner*—Danielle Somrak
(74) *Attorney, Agent, or Firm*—Knobbe, Martens, Olson & Bear, LLP

(57) ABSTRACT

The present invention includes an improved metal fence post for use with a wooden fence. The fence post has a U-shaped center section positioned between two flanges, and each of the flanges includes a plurality of holes extending along an edge. The fence post can be used as a line post, corner post or end post. Preferably, the thickness of the sides of the U-shaped center section is about the same as the thickness of the wooden fence rails so that the fence posts are positioned in-line with the fence rails. Advantageously, the fence posts allow the fence boards to be attached to either or both sides of the rails.

25 Claims, 14 Drawing Sheets

METAL FENCE POST

BACKGROUND OF THE INVENTION

1. Field of the Invention

The present invention generally relates to fencing and, in particular, to metal fence posts. More particularly, the present invention is an improved metal fence post which is used in conjunction with a wood fence.

2. Description of Related Art

Traditionally, wooden fence posts have been used to construct a wooden fence. Wooden fences are very desirable because of the appearance of the fence, especially for residential homes. As illustrated in FIG. 1, a conventional wood fence 8 includes a series of vertically oriented posts 10 which are inserted into a hole in the ground and the hole is then filled with dirt and/or cement. The posts 10 typically have a generally square cross-section with a width and depth of about four inches. The posts 10 are connected by two or more horizontally oriented wooden rails 12. The rails 12 are typically constructed from pieces of wood measuring two inches by four inches in cross section, commonly referred to as two-by-fours. Wooden slats or fence boards 14 are then attached to the 12 rails to create the fence 8.

The wooden fence posts used to construct the fence, however, have a number of disadvantages. For example, wooden fence posts decompose and decay, especially the portion of the post in or near the ground. Additionally, if the posts are set in concrete, there is a danger of breakage because the posts lack resilience about their base. Finally, the wooden fence posts are typically replaced every 5–10 years because of the deterioration and rotting of the wood.

It is known to use galvanized steel pipes in place of conventional wooden fence posts. For example, as disclosed in U.S. Pat. No. 5,297,890 issued to Commins, a steel pipe is inserted into the ground and a bracket is attached to the pipe by one or more bolts. The bracket is then connected to a conventional wooden fence rail. Disadvantageously, this system requires a significant amount of time to correctly position and attach the bracket to the pipe, and the system is expensive because it requires brackets and bolts. Additionally, the aesthetics of the fence are compromised because the galvanized pipe protrudes outwardly from the wooden fence and the color of the pipe does not match the color of the fence.

It is also known to directly attach the wooden rails of a typical fence to a galvanized steel pipe. In particular, holes must be drilled or punched through the pipe and the wooden rails are then bolted to the pipe. Disadvantageously, it requires a significant amount of time to drill the holes in the pipe and to attach the fence rails to the pipe. Further, because of the great contrast between the galvanized steel pipe and the wooden fence, the aesthetics of the fence are compromised.

As shown in FIG. 2, a known fence post 16 is constructed from steel and it includes a first flange 18, a second flange 20 and a V-shaped notch 22. One side of a standard fence rail 12 is fastened to the flanges 18, 20 of the post 16 and wooden slats 14 are attached to the other side of the fence rails. Disadvantageously, the V-shaped notch 22 of the fence post 16 protrudes outwardly from the fence line created by the fence rails 12 and slats 14, and this ruins the aesthetics of the fence. In addition, the metal fence posts detract from the appearance of the wooden fence and the outwardly extending V-shaped notch 22 may create a safety hazard.

In order to create an aesthetically pleasing fence, known steel fence posts must be painted to match the color of the wood. For example, if a natural wood fence is desired, the steel posts are painted to match the color of the wood, but this is often very difficult because the wood may have many different colors, patterns and textures. On the other hand, if the fence and steel fence post are painted the same color, after a relatively short period of time the fence posts and fence are different colors because the steel posts and wooden fence components weather and change color at different rates. Further, in order to paint the steel fence posts, an expensive powder or primer coating is often necessary. This adds to the cost of the fence and increases the complexity of manufacturing the fence posts.

Thus, known metal fence posts used with conventional wooden fences compromise the aesthetics of the fence because the metal posts detract from the appearance of the fence. Further, in addition to being difficult to use and costly to install, conventional metal fence posts can only be used in certain configurations.

SUMMARY OF THE INVENTION

A need therefore exists for a metal post for use with a wooden fence which is simple to use and easy to install, and which eliminates the above described disadvantages and problems.

One aspect of the present invention is a metal fence post including a center section and two outwardly extending flanges. A series of openings extend vertically along each of the flanges to allow wooden fence rails to be attached. Preferably, the thickness of the sides of the center section is about the same as the thickness of the wooden rails so that the fence posts are in-line with the fence rails. Advantageously, the fence posts allow the fence boards to be attached to either or both sides of the rails, and the fence posts, rails and fence boards are generally aligned.

Another aspect of the present invention is a fence post for an in-line wooden fence. The fence post includes an elongated member with a first end configured to be inserted into the ground and a second end configured to support a wooden fence. The fence post also includes a first flange extending along a first edge of the elongated member, a second flange extending along a second edge of the elongated member, and a center channel positioned between the first flange and the second flange. Preferably the channel has side walls about 1½ inches in length, which is approximately the same as the width of a standard two-by-four. More preferably, the center channel has a generally U-shaped configuration.

Yet another aspect of the invention is a fence post including an elongated member with a first side and a second side which form a front surface. A connecting portion interconnects the first side and the second side, and the connecting portion includes a rear surface. The distance between the front and rear surfaces of the fence post is preferably about 1½ inches to match the width of a standard two-by-four. Thus, when a standard two-by-four is attached to the fence post, the front and rear surfaces of the two-by-four are generally aligned with the front and rear surfaces of the fence post.

Still another aspect of the invention is a fence system including a fence post having a front surface, a rear surface, a first side, a second side and a connecting portion interconnecting the first side and the second side. The fence system also includes a rail having a front surface and a rear surface, the rail preferably having a width of about 1½ inches. The connecting portion of the fence post is configured to contact and abut the rail such that the front surface of the rail and the front surface of the fence post are generally aligned, and the rear surface of the rail and the rear surface of the fence post are generally aligned. Desirably, the fence system also includes fence boards attached to the front and/or rear sides of the rail. Advantageously, the fence boards may conceal the fence posts.

Yet another aspect of the present invention is an elongated fence post including a first flange including a plurality of openings, a second flange including a plurality of openings, and a center section connecting the first flange and the second flange. The center section of elongated fence post preferably includes a first side, a second side, and a back side. Preferably, one or more clips including a body section and a foot section are releasably attached to the fence post. In particular, the foot section of the clip is configured to be attached to one or more openings in the flanges and the body section is configured to be attached to various fence components such as a top clip which attaches a top cap or board to the top of the fence; an end clip which attaches a fence board or end cap to an end of the fence; or a corner clip which attaches a fence rail to the fence post.

A further aspect of the present invention is a method of constructing a fence which includes inserting a fence post into the ground. The fence post includes a front surface, a rear surface, a first side, a second side and a connecting portion interconnecting the first side and the second side. One or more fence rails are placed on either side of the fence post so that the front surfaces of the fence rails are generally aligned with the front surface of the post and the rear surfaces of the fence rails are generally aligned with the rear surface of the post. The fence rails are then attached to the fence post.

Advantageously, the metal fence post of the present invention allows the fence to be constructed in a variety of configurations. For example, the same fence post can be used as a line, corner or end post. Thus, the fence post of the present invention is very versatile. Additionally, the fence post can be used with the fence boards in a variety of different combinations to create different appearances or the desired aesthetics. Thus, the fence post disclosed herein has a wide variety of uses and applications.

Further aspects, features, and advantages of the present invention will become apparent from the following detailed description of the preferred embodiments.

BRIEF DESCRIPTION OF THE DRAWINGS

The appended drawings contain figures of the prior art designs, which were discussed above, and figures of the preferred embodiments of the present metal fence post. The above-mentioned features of the metal fence post, as well as other features, will be described in connection with the preferred embodiments; however, the illustrated embodiments are only intended to illustrate the invention and not limit the invention. The drawings contain the following figures.

DETAILED DESCRIPTION OF THE PREFERRED EMBODIMENT

The present invention involves an improved metal fence post for use with a wooden fence. The principles of the present invention, however, are not limited to metal fence posts used with wooden fences and it will be understood that, in light of the present disclosure, the fence posts disclosed herein can be successfully used in connection with other types of fences, walls and barriers.

Additionally, to assist in the description of the metal fence posts and fence systems, words such as upward, downward, vertical and horizonal are used to describe the accompanying figures. It will be appreciated, however, that the present invention can be located in a variety of desired position—including various angles, sideways and even upside down. A detailed description of the metal fence post now follows.

Figure 1:
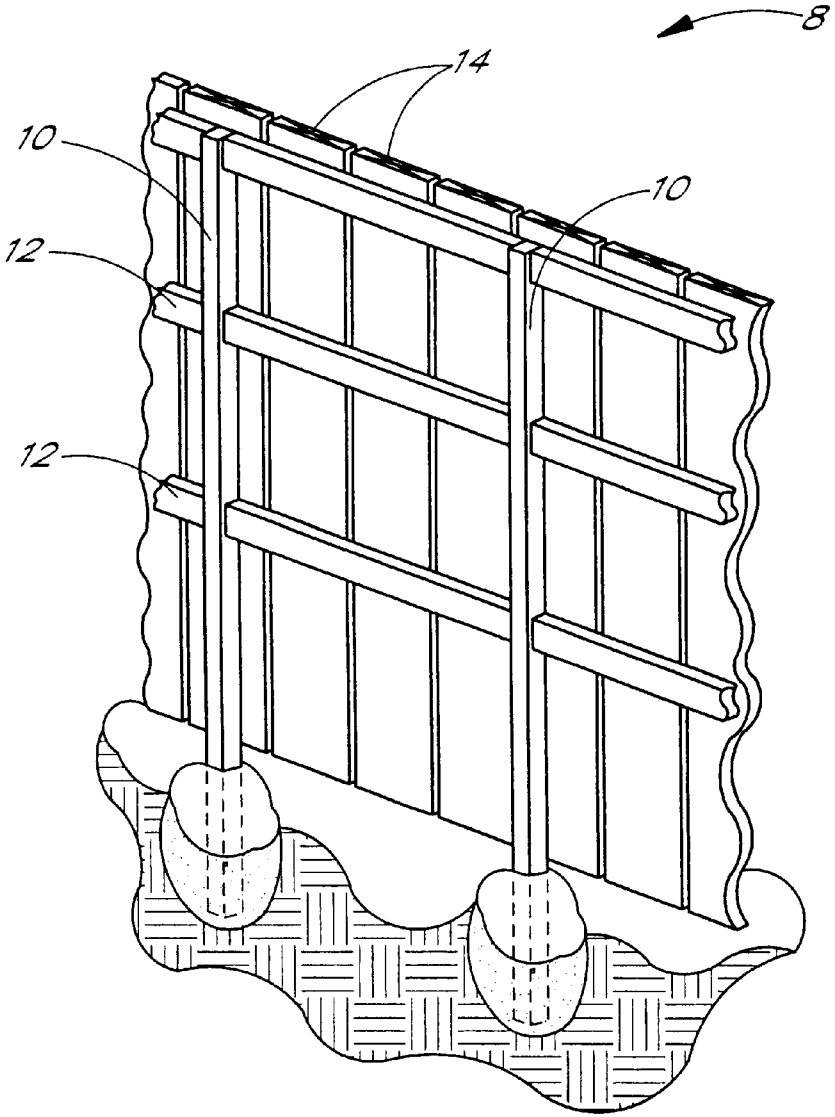
FIG. 1 (PRIOR ART)
FIG. 1 is a perspective view of a portion of a conventional wooden fence, illustrating wooden fence posts, rails and slats.
Figure 2:
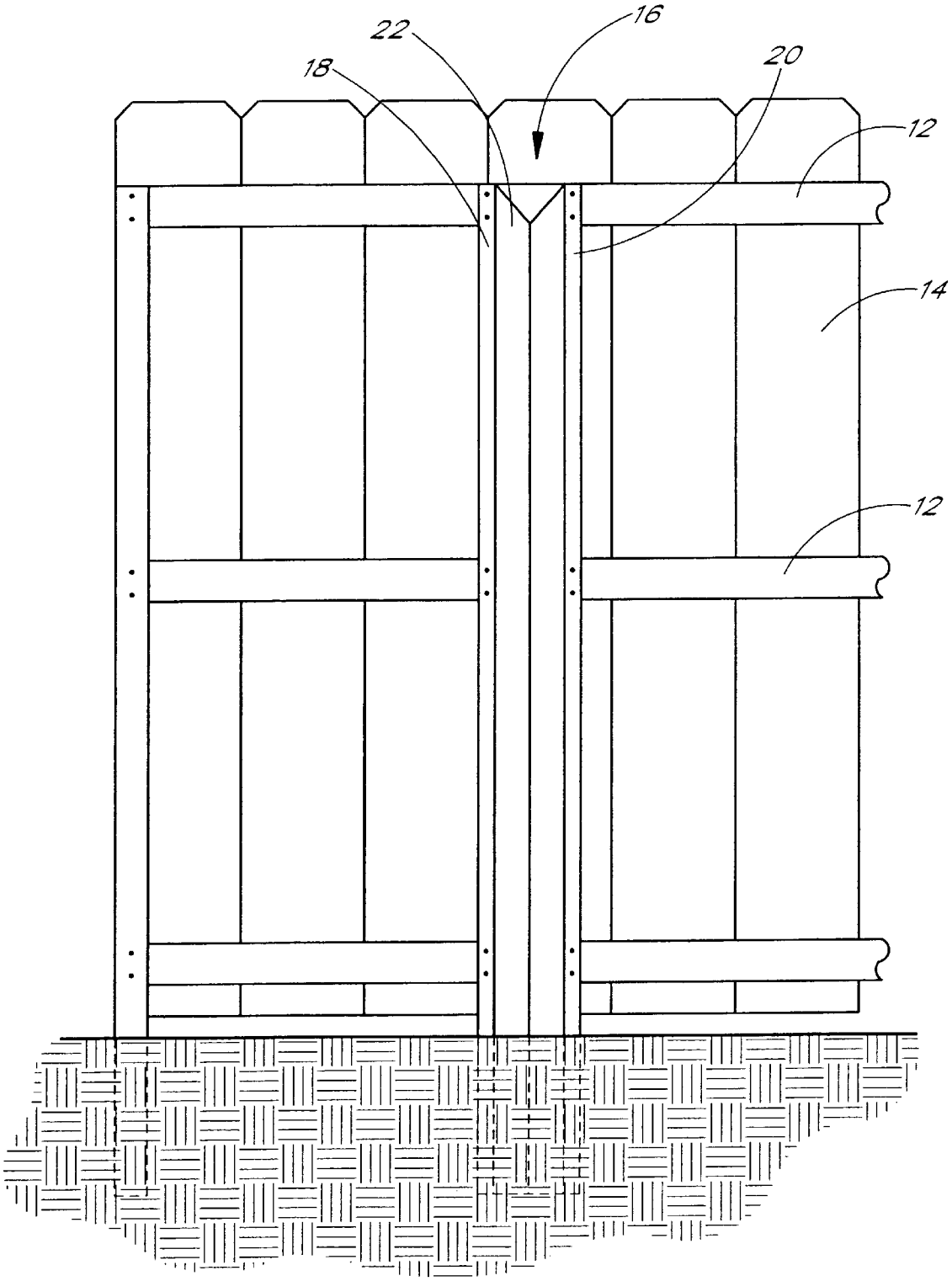
FIG. 2 (PRIOR ART)
FIG. 2 is a front view of a conventional wooden fence, illustrating a known metal fence post.
Figure 3:
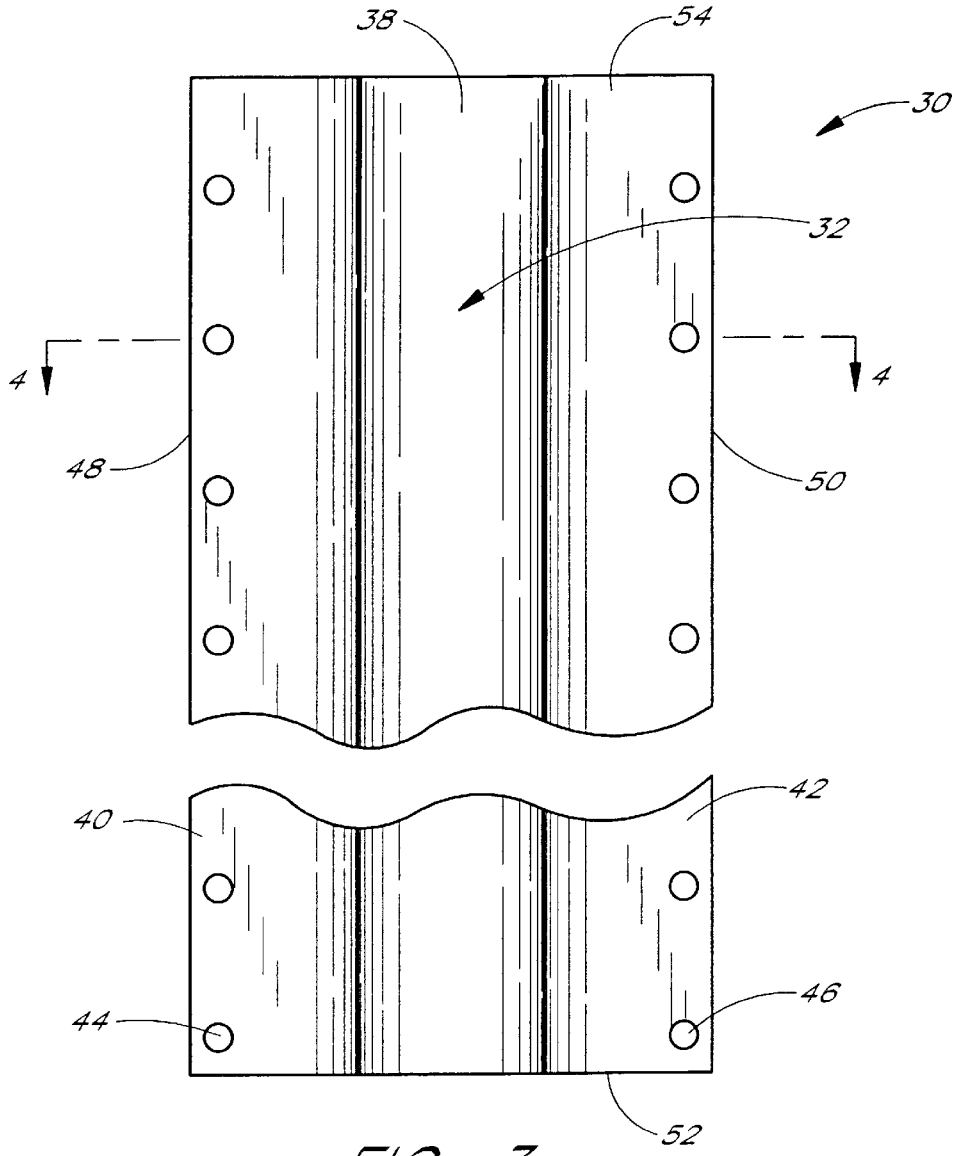
FIG. 3 is an enlarged front view of the metal fence post in accordance with a preferred embodiment of the present invention.
Figure 4:
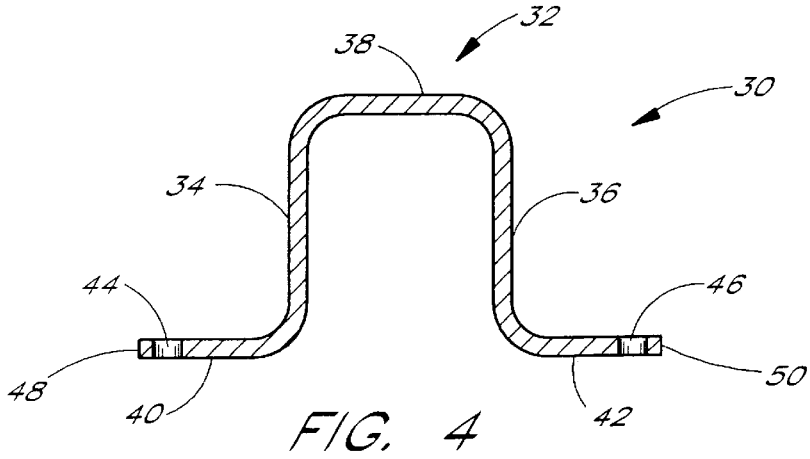
FIG. 4 is a cross-sectional side view taken along lines 4—4 of the metal fence post shown in FIG. 3.

FIGS. 3 and 4 illustrate a metal fence post 30 constructed in accordance with a preferred embodiment of the present invention. The metal fence post 30, having a first end 52 and a second end 54, includes a substantially U-shaped center section 32 with a first side wall 34, a second side wall 36 and a rear wall 38. The walls 34, 36 and 38 are generally straight and located at about 90° angles to form the U-shaped configuration, and the side walls 34 and 36 are generally parallel. The U-shaped configuration creates a channel 32 with the minimum amount of material. Connected to the first side wall 34 is a first flange 40 and connected to the second side wall 36 is a second flange 42. The flanges 40 and 42 are orthogonal to the side walls 34 and 36, respectively, and the flanges are generally aligned in the same plane. As shown in the accompanying figures, the intersection of the walls 34, 36, 38 and flanges 40, 42 are preferably slightly rounded with a radius of about 0.094 inches, but the walls and flanges may be joined with any desired curvature or radius, and at any desired angle.

The flanges 40 and 42 of the fence post 30 are preferably aligned in generally the same plane and the flanges are separated by the channel 32, which forms a connecting portion between the flanges 40 and 42. The channel 32 advantageously greatly increases the strength of the fence post 30 and it allows the fence post to be constructed of relatively thin material. Additionally, because the channel 32 and flanges 40, 42 preferably extend the entire length of the fence post 30, the fence post has great strength both above the ground and below the ground.

Figure 26A:
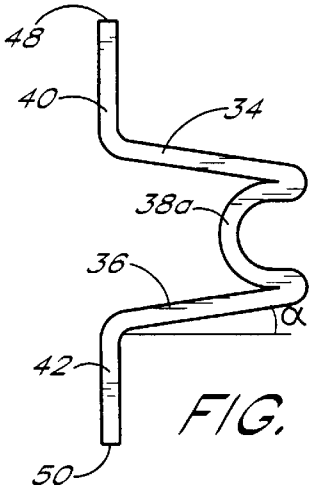
FIG. 26A is a side view of the metal fence post in accordance with still another preferred embodiment of the present invention.
Figure 26B:
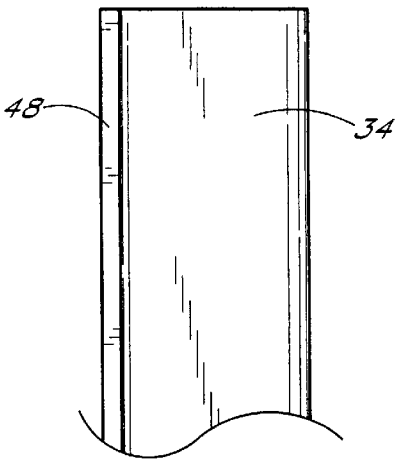
FIG. 26B is a left side view of the fence post shown in FIG. 26A, with a portion of the fence post cut away.
Figure 25A:
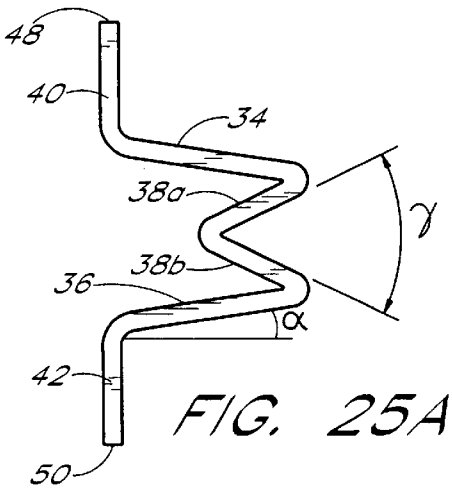
FIG. 25A is a side view of the metal fence post in accordance with yet another preferred embodiment of the present invention.
Figure 25B:
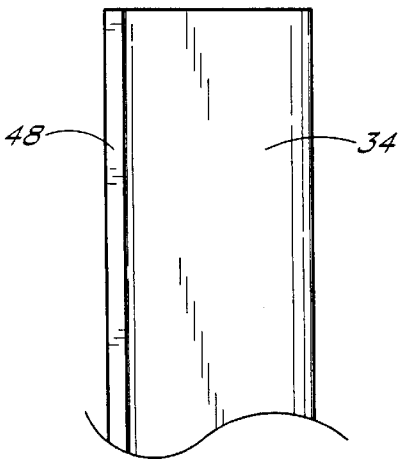
FIG. 25B is a left side view of the fence post shown in FIG. 25A, with a portion of the fence post cut away.
Figure 24A:
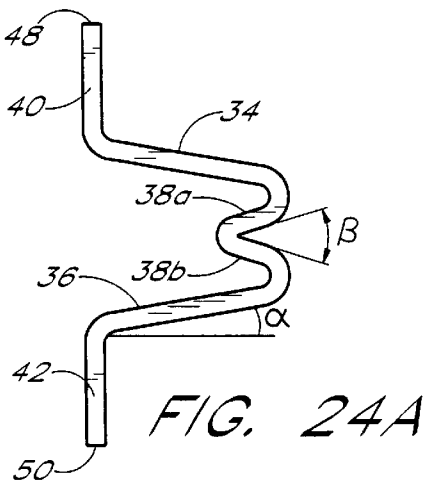
FIG. 24A is a side view of the metal fence post in accordance with another preferred embodiment of the present invention.
Figure 24B:
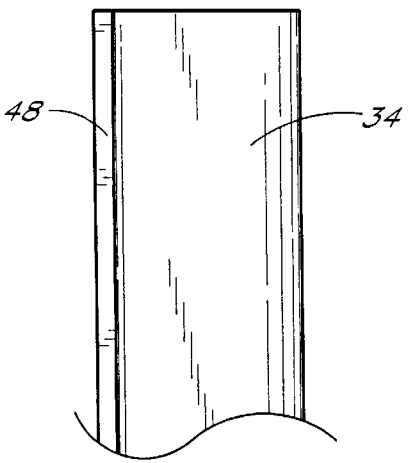
FIG. 24B is a left side view of the fence post shown in FIG. 24A, with a portion of the fence post cut away.

The fence post 30, however, can also have center sections 32 with various configurations. For example, as shown in FIGS. 24–26, the side walls 34 and 36 are of the channel 32 angled inwardly at an angle a between about 0° and about 20° and, more preferably, at an angle of about 10°, but the side walls can be angled inwardly or outwardly at any desired angle. Additionally, the rear wall 38 of the center section 32 can have different shapes and configurations. For example, as seen in FIGS. 24A and 24B, the rear wall 38 includes two inwardly extending legs 38*a* and 38*b* which are joined at an angle β of about 40° or, as seen in FIGS. 25A and 25B, the rear wall includes two inwardly extending legs which are joined at an angle γ of about 52°. It will be understood that the legs may have any desired length and may be joined at any desired angle. In addition, as seen in FIGS. 26A and 26B, the rear wall 38 may include an inwardly curved surface 38*a* which joins the side walls 34 and 36 of the channel 32. It will be appreciated that the rear wall 38 can have a various radii of curvatures and that the rear wall can include, for example, compound curved surfaces or multiple straight surfaces. Thus, it will be appreciated that the walls 34 and 36 can be located at various angles relative to the flanges 40 and 42, and the rear wall 38 can have different configurations. Advantageously, these angled and/or curved surfaces may further increase the strength of the fence post 30.

The metal fence post 30 preferably has an overall length of about 7 feet 8 inches and either end of the post can be driven into the ground. Preferably, in order to construct a fence about 6 feet tall, the fence post 30 is driven approximately 2 feet into the ground, but it will be appreciated that the fence post may have any desired length and any amount of the fence post can be inserted into the ground, depending, for example, upon the desired height and/or strength of the fence.

The fence post 30 is desirably sized and configured to be used with fence rails and fence boards having standard sizes. As known in the industry, fence rails are typically "two-by-fours" and fence boards are generally "one-by-sixes." However, it is known that the actual dimensions of a standard two-by-four are about 1½ inches by about 3½ inches, and a one-by-six is about ⅝ of an inch by about 5½ inches. It will be appreciated that although the fence posts 30 described herein are in connection with standard sized two-by-fours and one-by-sixes, the fence posts may be sized and configured to be used with fence rails and fence boards of different sizes.

In particular, the side walls 34 and 36 of the U-shaped center section 32 have a depth of about 1½ inches which matches the actual thickness of a finished two-by-four. The end wall 38 of the center section 32 has a width of about 1½ inches and the flanges 40, 42 have a width of about 1⅛ inches. The fence post 30 has an overall width of about 3½ inches and depth of about 1¾ inches but, as discussed above, the fence post may have different dimensions depending, for example, upon the size and configuration of the rails and fence boards. Additionally, the dimensions of the fence post may be slightly larger or smaller, for example, depending upon the desired use of the posts.

The fence post 30 is preferably constructed from steel and more particularly from 60,000 psi steel. The thickness of the steel is preferably about ⅛ of an inch, but the steel may have any desired thickness. It will be appreciated that the post 30 can also be constructed from other types of steel, metals and other materials with suitable characteristics such as plastics or composite materials. Additionally, the fence post 30 is preferably constructed from a high-strength material and, more preferably, the fence post 30 is constructed from a material which allows a fence to be constructed to meet Uniform Building Code Section 1622 exposure B for 70 mph wind load, but the fence posts can have any desired strength characteristics. Further, the fence post 30 may be coated with materials such as paint, for example, to match the fence post with the fence or other materials to inhibit rusting of the post.

Each of the flanges 40, 42 include a series of openings 44, 46 respectively which extend along the edges 48, 50 of flanges. The openings 44, 46 extend through the flanges 40, 42 respectively and the openings are preferably circular with an inner diameter of about ¼ of an inch, but the openings can be larger or smaller. The openings 44, 46 are spaced about 3⁄16 of an inch from the edges 48, 50 of the flanges 40, 42 respectively, and the openings 44, 46 are preferably spaced about 1 inch apart, but the openings may have any desired spacing and arrangement. One skilled in the art will understand that instead of openings 44 and 46, the fence post 30 may include perforations, indentations, markings, etc., and the fence post can be constructed without openings.

The fence post 30 is preferably manufactured by cutting a piece of steel to the desired dimensions and then forming the steel into the desired shape of the fence post. It will be understood these steps may be performed simultaneously or independently. Alternatively, the fence post 30 could be stamped and formed from a sheet of steel. Advantageously, the openings 44 and 46 can be formed when the post 30 is stamped, but the openings may also be formed by drilling, punching, etc.

Figure 6:
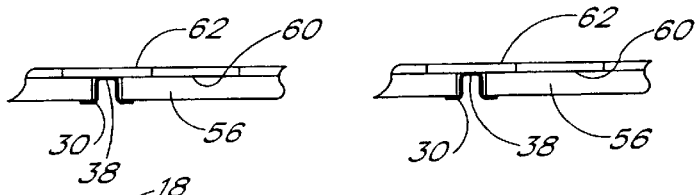
FIG. 6 is a top view of the fence system shown in FIG. 5.
Figure 5:
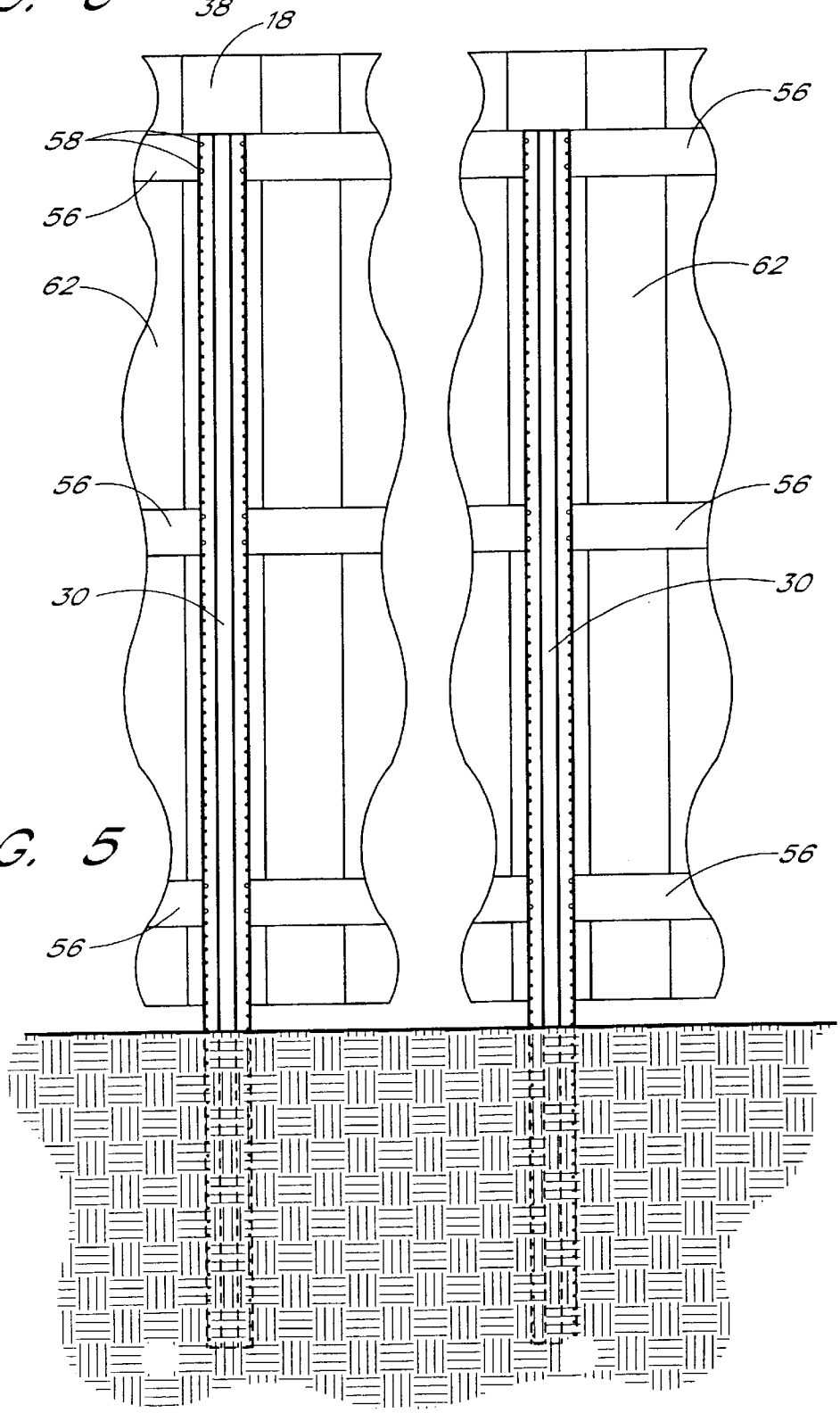
FIG. 5 is a front view of a fence system using the metal fence post shown in FIG. 3, illustrating metal fence posts supporting a portion of a wooden fence.

In a preferred embodiment of the present invention, as shown in FIG. 5, the fence posts 30 are driven into the ground. Alternatively, holes could be created in the ground or other support surface and the posts 30 can be inserted into the openings. The openings may then be filled with a material such as dirt or cement. As best seen in FIGS. 5 and 6, wooden rails 56 are positioned to contact and abut the flanges and side walls of the fence posts 30. In particular, an end of a first rail 56 is positioned to contact and abut the first side wall 34 and the first flange 40 on one side of the fence post 30. Additionally, a second rail 56 is generally horizontally aligned with the first rail but on the other side of the fence post 30, and an end of the second rail is positioned to contact and abut the second side wall 36 and the second flange 42 of the fence post.

One or more fasteners 58 such as nails or screws are used to attach the rails 56 to the fence post 30. As best seen in FIG. 6, the wooden rails 56, which desirably are standard two-by-fours, are attached to the fence post 30 so that the front surface 60 of the rail is generally aligned with the rear wall 38 of the fence post. Thus, the rails 56 and fence posts 30 are generally aligned and the fence posts preferably do not extend substantially outwardly from the line created by the rails.

Fence boards 62 are then attached to the front surface 60 of the rails 56 by fasteners (not shown) such as nails or screws. Advantageously, because the rails 56 and fence posts 30 are generally aligned, the fence boards 62 are also generally aligned and this creates a generally straight fence wherein the posts do not extend substantially outwardly from the fence line. Significantly, if fence boards are attached to one side of the fence, the fence posts 30 are generally hidden from view on that side of the fence, and if fence boards are attached to both sides of the fence, the fence posts are substantially hidden from view of both sides of the fence.

It will be appreciated that any number of rails 56 may be attached to the fence post 30 and the rails may have any desired spacing and orientation. As shown in FIG. 5, three exemplary rails 56 are attached to the fence posts 30. Additionally, the fence boards 62 may be attached to the rails 56 in any desired manner and at any desired angle. Further, the fence boards 62 may be attached at any desired heights and distances from the ground.

Figure 7:
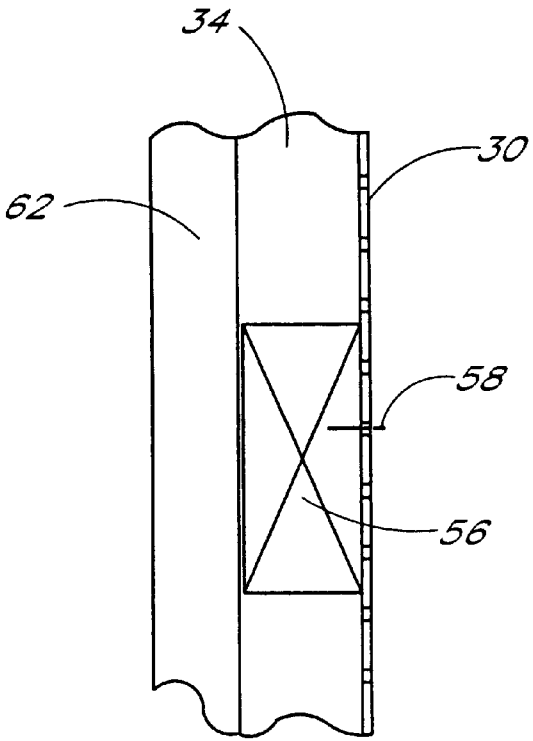
FIG. 7 is an enlarged side view of a portion of the fence system shown in FIG. 5.
Figure 8:
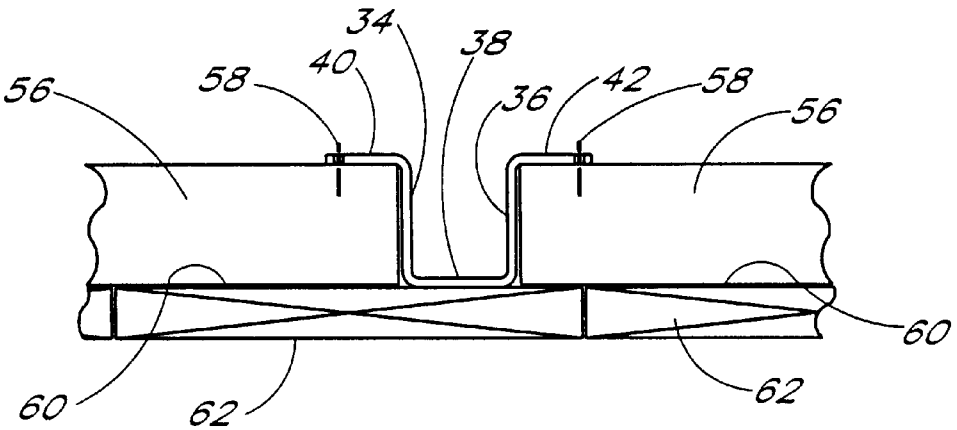
FIG. 8 is an enlarged top view of the fence system shown in FIG. 5.

The details of the arrangement and connection of the fence post 30, rails 56 and fence boards 62 are best seen in FIGS. 7 and 8. As seen in FIG. 8, one end of a first rail 56 contacts and abuts the first flange 40 and the first side wall 34 of the fence post 30. One or more fasteners 58 are used to attach the fence rail 56 to the fence post 30. An end of a second rail 56 contacts and abuts the second flange 42 and the second side wall 36 on the opposing side of the fence post 30. One or more fasteners 58 are also used to attach this rail 56 to the fence post 30. The fence boards 62 are then connected by fasteners (not shown) to the rails 56.

Figure 9:
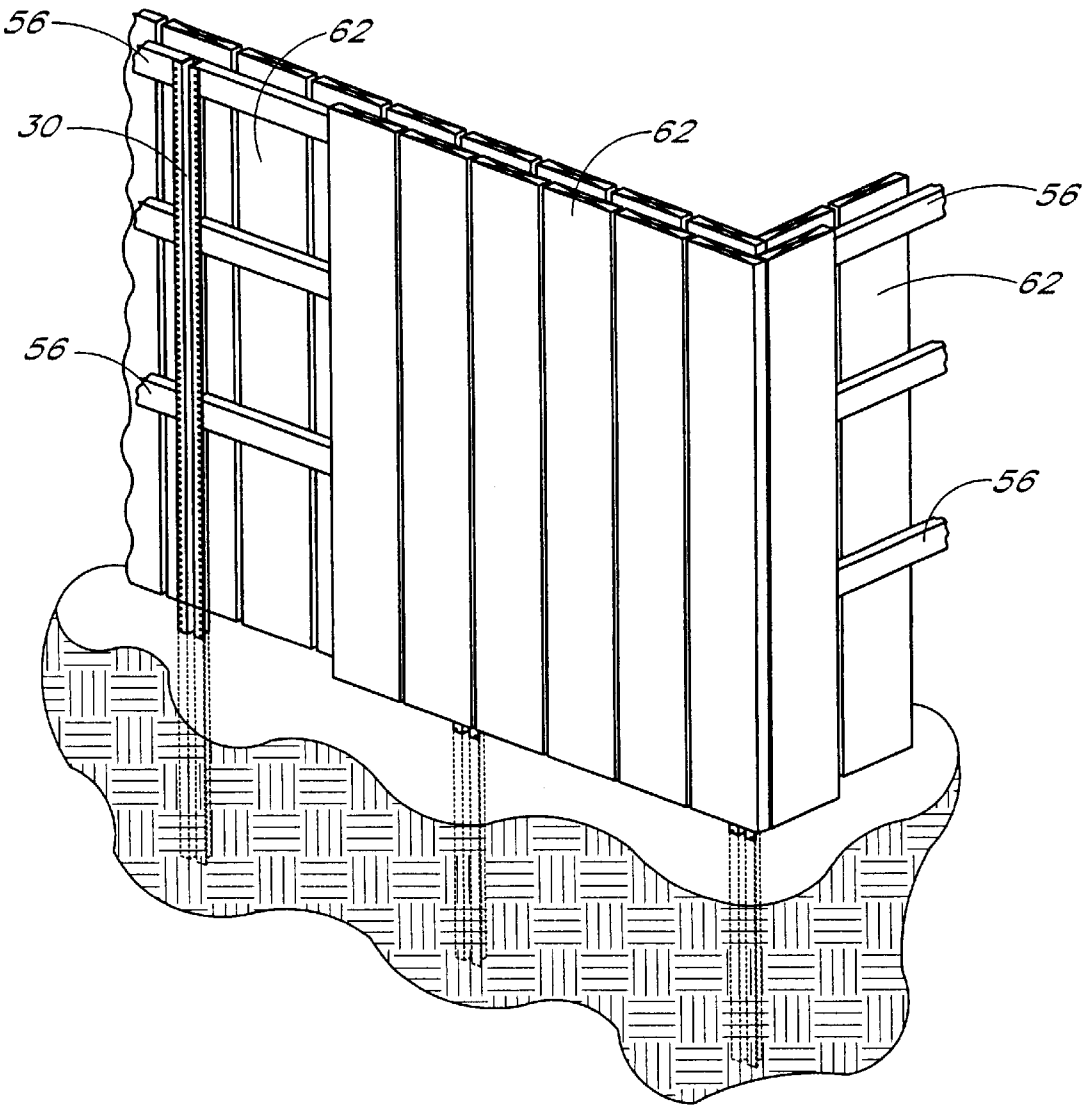
FIG. 9 is a perspective view of a portion of a fence system using the metal fence post shown in FIG. 3, illustrating a portion of the fence with fence boards attached to each side of the rails.

As seen in FIG. 9, the fence boards 62 advantageously can be attached to either side of the rails 56 and fence posts 30. Significantly, because the posts 30 do not substantially extend from the line created by the rails 56 and posts, the fence boards 62 can be attached to both sides of the fence in generally parallel, straight lines. Advantageously, when fence boards are attached to both sides of the rails, this entirely conceals the fence posts 30 within the fence and the fence appears to be entirely constructed of wood. Thus, an aesthetically pleasing fence which appears to be entirely constructed of wood is created.

As best seen in FIGS. 10–18, the fence post 30 may be used with various clips to allow different items to be connected to the post. It will be understood that the fence post 30 does not require the use of these clips, but the clips can be used depending upon the desired application or configuration of the fence. Advantageously, these optional clips greatly increase the versatility of the fence posts 30.

Figure 11:
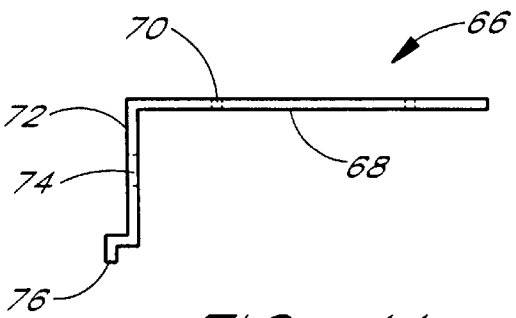
FIG. 11 is a side view of the top clip shown in FIG. 10.
Figure 10:
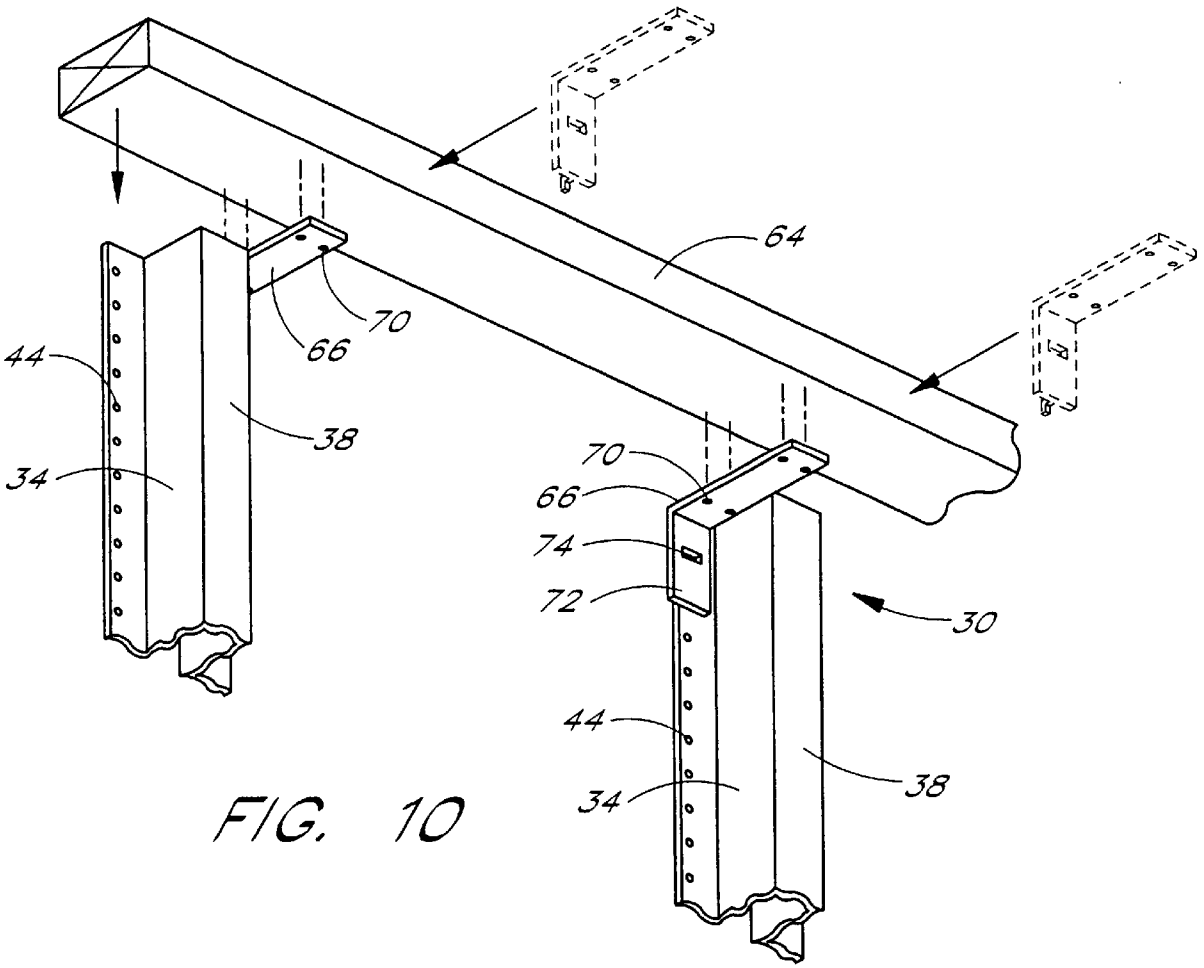
FIG. 10 is an exploded perspective view of a portion of the metal fence post shown in FIG. 3, illustrating a top clip and a top cap.

For example, as seen in FIG. 10, the fence post 30 may be used with a top cap 64 which is positioned at least partially above or near the fence post. The top cap 64 is preferably a two-by-six, but the top cap may have any desired dimensions and shape. Preferably, a top clip 66 is used to connect the top cap 64 to the fence post 30. As seen in FIGS. 10 and 11, the top clip 66 is generally L-shaped with a body portion 68 about 3½ inches in length and about 1¼ inches in width. The body 68 includes four holes 70 in a rectangular pattern, but the body may include any number of openings, including none, in any desired pattern. The top clip 66 also includes a flange 72 which is generally orthogonal to the body 68. The flange 72 is about 1¾ inches in length and it includes an opening 74 and an extension 76. The extension 76 is configured to fit through a selected opening 44, 46 in the fence post 30 and the opening 74 is spaced to be aligned with an opening 44, 46 in the fence post 30. A fastener (not shown) such as a bolt, nail, or screw may be inserted through the aligned opening 74 and openings 44, 46 to attach the clip 66 to the fence post 30. The top cap 64 is attached to the top clip 66 by one or more fasteners (not shown), such as nails or screws, inserted through the holes 70.

Figure 12:
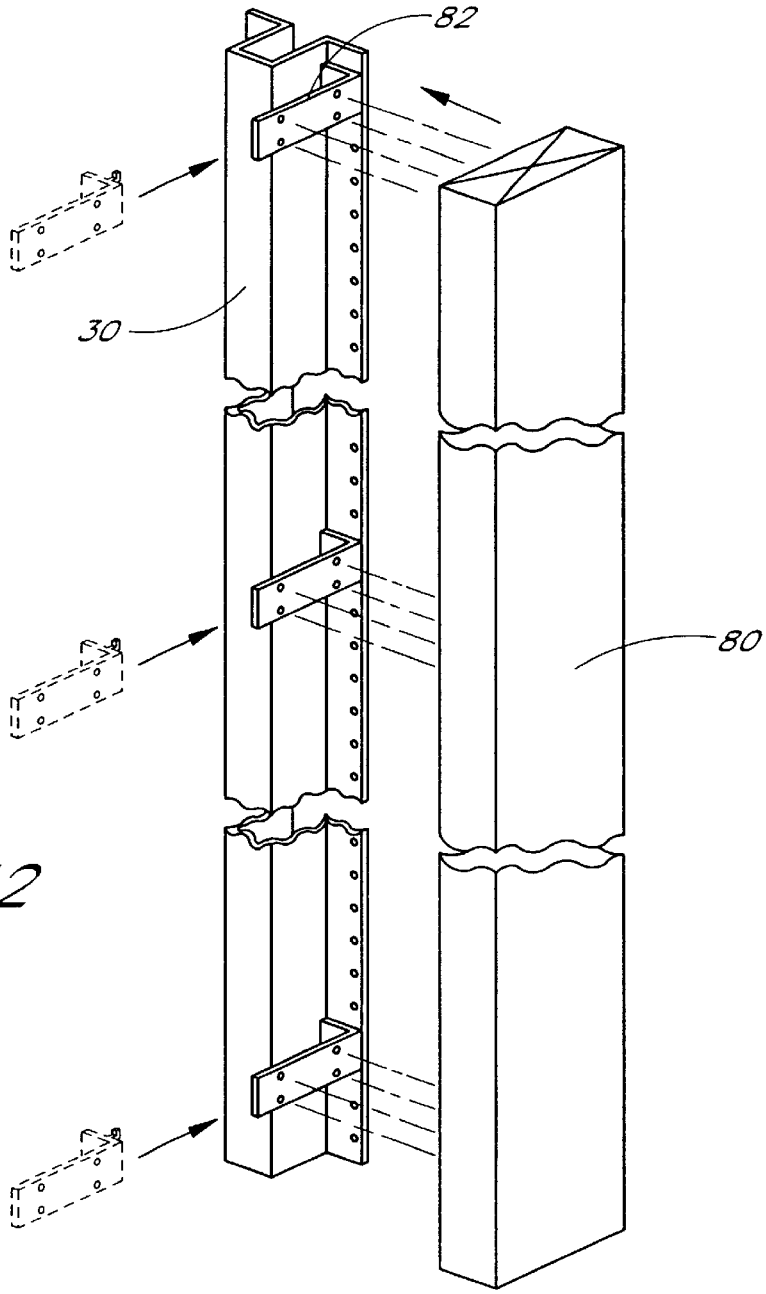
FIG. 12 is an exploded perspective view of the metal fence post shown in FIG. 3, a portion of which is cut away, illustrating an end clip and an end cap.
Figure 13:
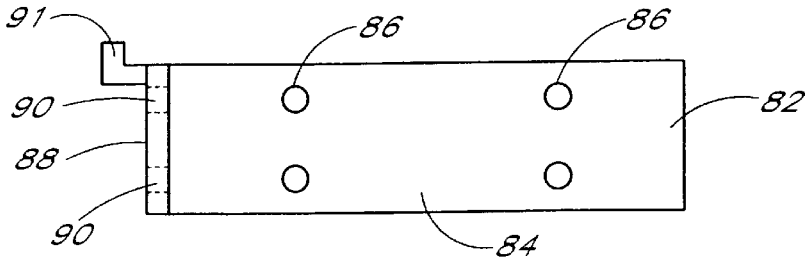
FIG. 13 is a side view of the end clip shown in FIG. 12.

An end cap 80 may be attached to the fence post 30 by an end clip 82 as shown in FIGS. 12 and 13. The end cap 80 is preferably a one-by-six, but the end cap may have any desired dimensions and shape. The end clip 82 is generally L-shaped with a body portion 84 about 3 inches in length and about 1¼ inches in width. The body 84 includes four holes 86 located in a rectangular configuration with the larger sides of the rectangle about 1½ inches in length and the shorter sides of the rectangle about ¾ of an inch, but the body may have any number of holes in any desired pattern. The end clip 82 also includes an orthogonal flange 88 with two holes 90 spaced about 1 inch apart. The end clip 82 also includes an extension 91 which is configured to fit through an opening 44, 46 in the fence post 30. The holes 90 are desirably spaced to be aligned with selected openings 44, 46 in the fence post 30. A fastener (not shown) such as a bolt, nail, or screw may be inserted through the aligned openings to attach the clip 82 to the fence post 30. The end cap 80 is attached to the end clip 82 by one or more fasteners inserted through the holes 86 in the clip.

Figure 14:
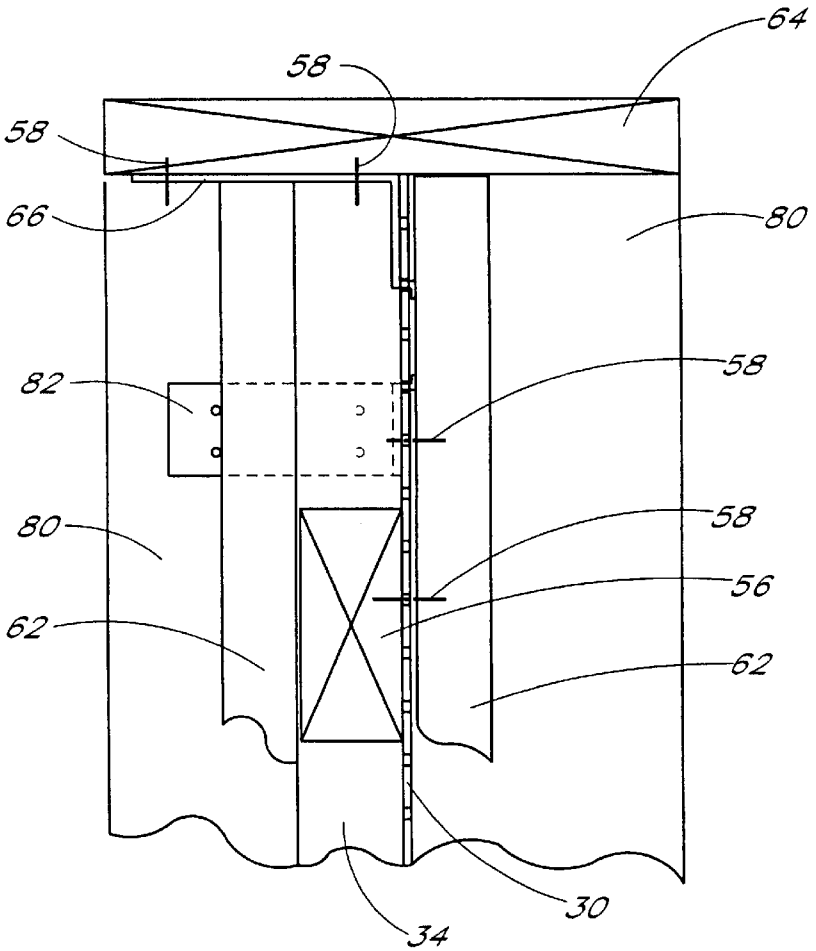
FIG. 14 is a side view of a portion of a fence system, illustrating a metal fence post, a top clip, a top cap, an end clip and an end cap.
Figure 15:
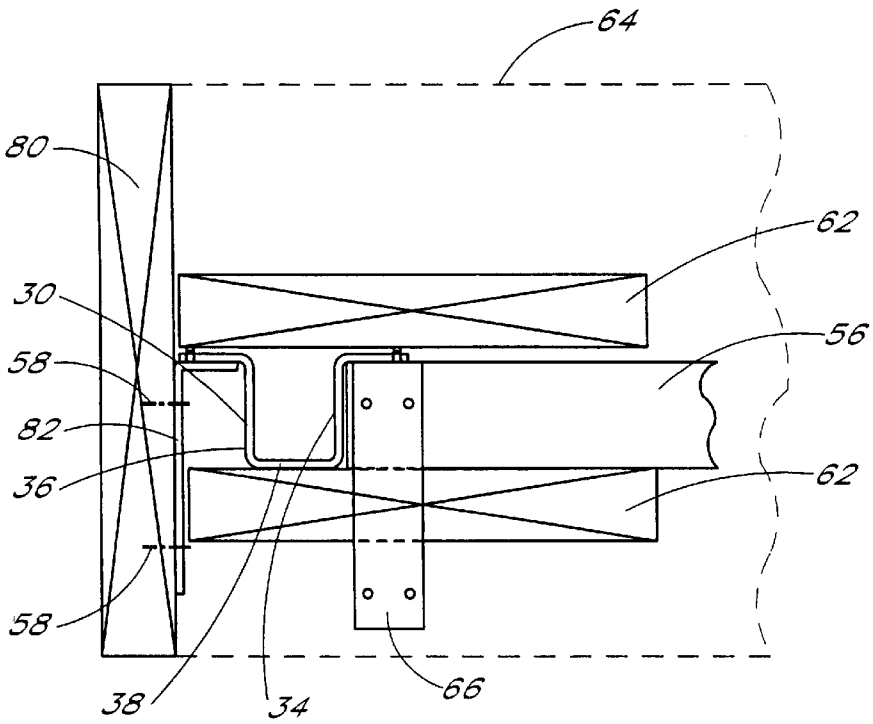
FIG. 15 is a top view of the fence system shown in FIG. 14.

The end clips 82 and top clips 66 advantageously can be used simultaneously. As seen in FIGS. 14 and 15, an end clip 82 is used to attach an end cap 80 to the fence post 30 and a top clip 66 is used to connect a top cap 64 to the fence post (the top cap 64 is shown in phantom in FIG. 15). Thus, the clips 82 and 66 greatly increase the versatility of the fence posts 30 because the fence posts can be used in a variety of configurations with various components. Additionally, the clips 66 and 82 allow a strong and secure fence system to be created. Significantly, the top cap 64 and end cap 80 are not fastened to the ends or sides of the fence boards 62 because this often damages the fence boards and it does not securely fasten the caps to the fence boards.

Figure 16:
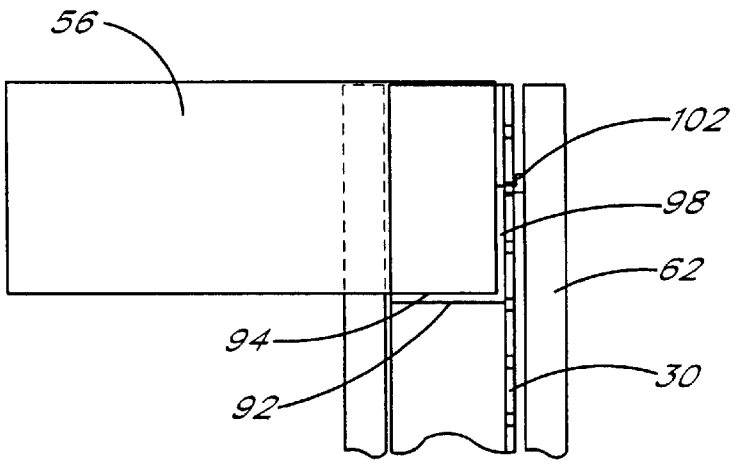
FIG. 16 is a side view of a portion of a fence system, illustrating a rail attached to a metal fence post by corner clip.
Figure 17:
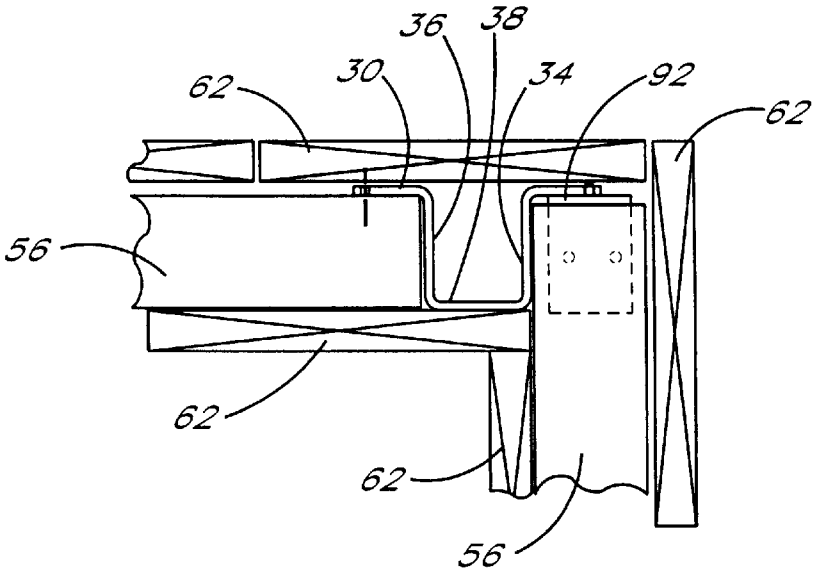
FIG. 17 is a top view of the fence system shown in FIG. 16.
Figure 18:
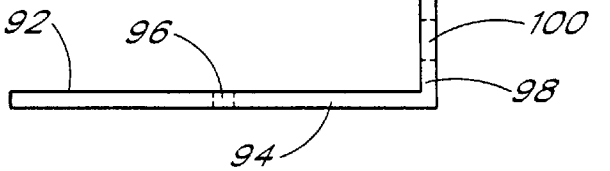
FIG. 18 is a side view of the corner clip shown in FIG. 16.

As seen in FIG. 16–18, the fence post 30 can also be used in conjunction with a corner clip 92 which is used to attach a rail 56 to the post 30. In particular, the corner clip 92 may attach the rail 56 to the post 30 at a corner of the fence. The corner clip 92 is generally L-shaped with a body 94 that is about 1½ inches in length and about 1¼ inches in width. The body 94 includes a centrally located hole 96, but the body can have additional or fewer holes. The corner clip 92 also includes an orthogonal flange 98 which is about 1¾ inches in length and it includes an opening 100 and an extension 102. The extension 102 is configured to fit through an opening 44, 46 in the fence post and the opening 100 is configured to be aligned with a selected opening in the fence post. A fastener (not shown) such as a bolt, nail, or screw may be inserted through the aligned opening 100 and opening 44, 46 to attach the clip 92 to the fence post 30. The rail 56 is attached to the corner clip 92 by a fastener such as a nail or screw inserted through the hole 96 in the body 94.

The flange 98 of the corner clips 92 advantageously can be swiveled slightly when attached to the fence post 30 and/or the body 94 may be bent at a slight angle relative to the flange. This allows the clip 92 to be used to accommodate grade changes in the terrain covered by the fence. That is, if the fence posts 30 are used to construct a fence on uneven or varied terrain, the clips 92 may position the rails 56 at an angle generally parallel to the terrain. Thus, a fence that generally follows uneven terrain can be constructed.

A fence system 110 that illustrates some of the various features and configurations of the components described above is shown in FIG. 19. For example, as shown in the central portion of the accompanying figure, the fence post 30 may be used as a line post 112 with rails 56 attached to the flanges 40, 42 on both sides of the fence post. Fence boards 62 may be attached to the front surface 60 of the rails 56 to create the fence. Advantageously, fence boards 62 may also be attached to the rear surface 61 of the rails 56 to conceal the fence post 30 within the fence. As previously described, the fence boards 62 may extend along all or a portion of the fence and/or either or both sides of the rails 56.

Figure 19:
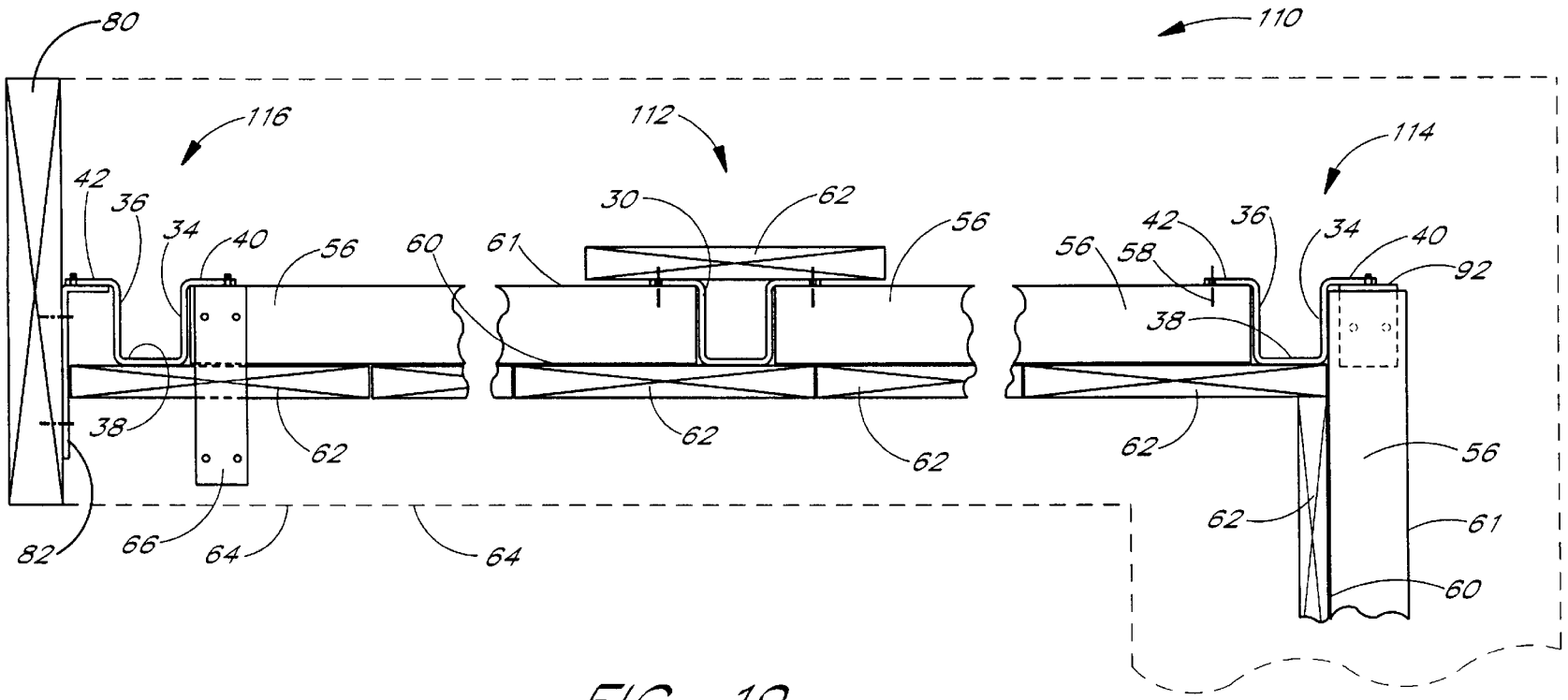
FIG. 19 is a top view of a fence system using the metal fence post shown in FIG. 3, with portions of the fence system cut away.

As seen on the right side of FIG. 19, the fence post 30 can be used as a corner post 114. In this embodiment, the rails 56 are generally aligned at right angles with one rail attached to the second flange 42 by one or more fasteners 58 and a second rail is connected by a corner clip 92 to the post 30. While the fence boards 62 shown in FIG. 19 are only attached to the front surface 60 of the rails 56, fence boards may also be attached to the rear surface 61 of the rails.

As seen on the left side of FIG. 19, the fence post 30 can also be used as an end post 116. In particular, a rail 56 is attached to the first flange 40 and an end clip 82 is attached to the second flange 42. An end cap 80 is attached to the end clip 82 by fasteners 58 and the end cap 80 is positioned at about a 90° angle with respect to the line created by the fence boards 62 and rails 56. A top clip 66 is also attached to the first flange 40 to connect the top cap 64 (shown in phantom) to the fence post 30.

Figure 20:
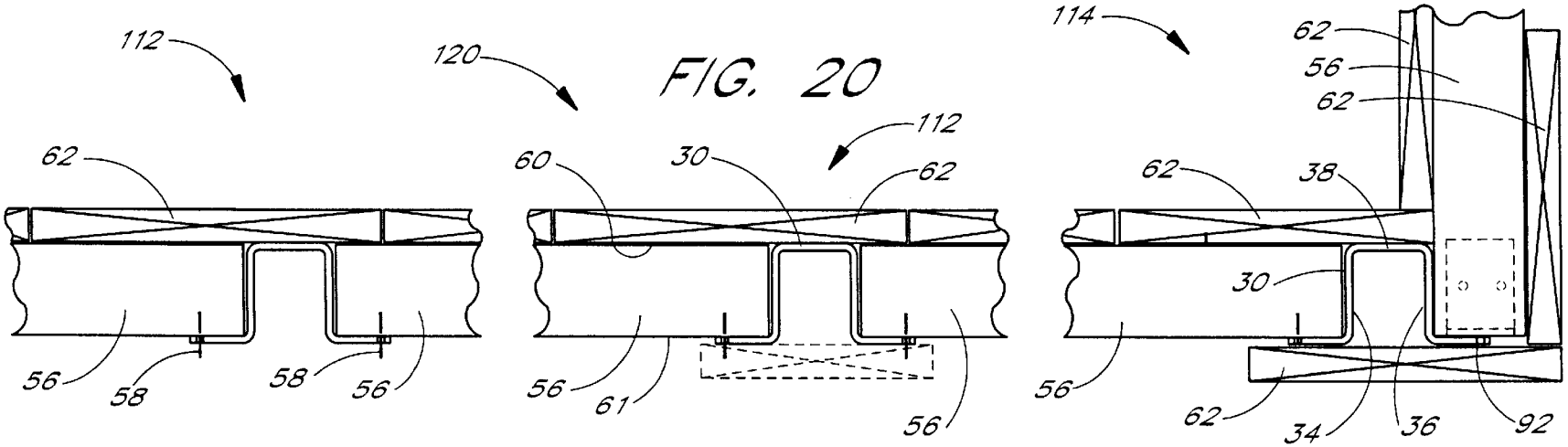
FIG. 20 is a top view of another fence system using the metal fence post shown in FIG. 3, with portions of the fence system cut away.
Figure 21:
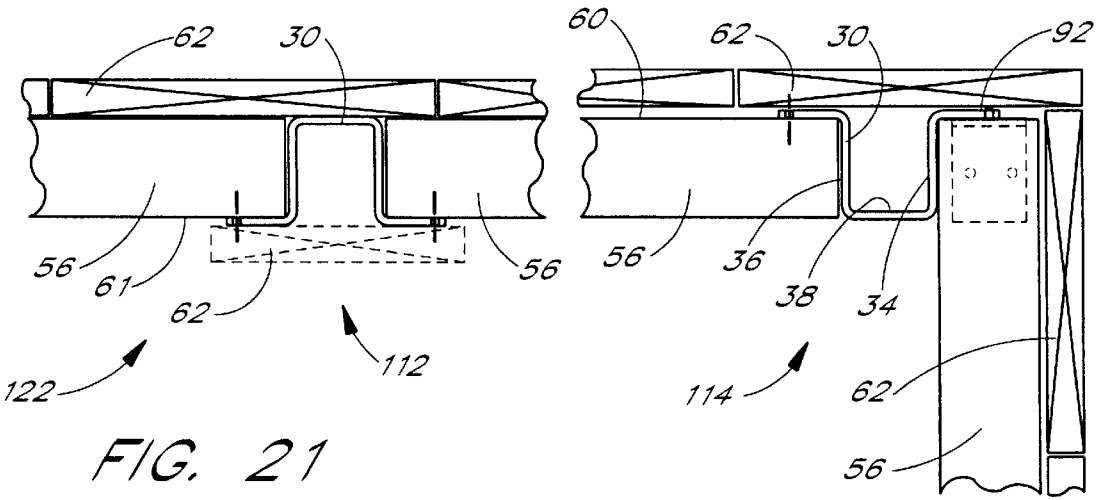
FIG. 21 is a top view of yet another fence system using the metal fence post shown in FIG. 3, with portions of the fence system cut away.

FIG. 20 illustrates a fence system 120 similar to that described above, but the arrangement of the corner post configuration is different. In particular, the fence system 120 includes two fence posts 30 which are used as line posts 112. As discussed above, the line posts 112 include fence rails 56 attached to both sides of the fence post 30 and fence boards 62 may be connected to the front surface 60 and/or rear surface 61 of the rails. The fence system also includes a corner post 114 with a corner clip 92 so that the rails 56 are generally positioned at about a 90° angle. Exemplary fence boards 62 shown in FIG. 20 may be located on each side of the rails 56. FIG. 21 illustrates yet another fence system 122, but with the corner post 114 is connected to the front surface 60 of the rail 56 and not the rear surface 61. Again, the corner post 114 can be exposed by attaching fence boards 62 to only one side of the fence, or the post can be concealed by placing fencing boards on both sides of the fence.

Figures 22, 23:
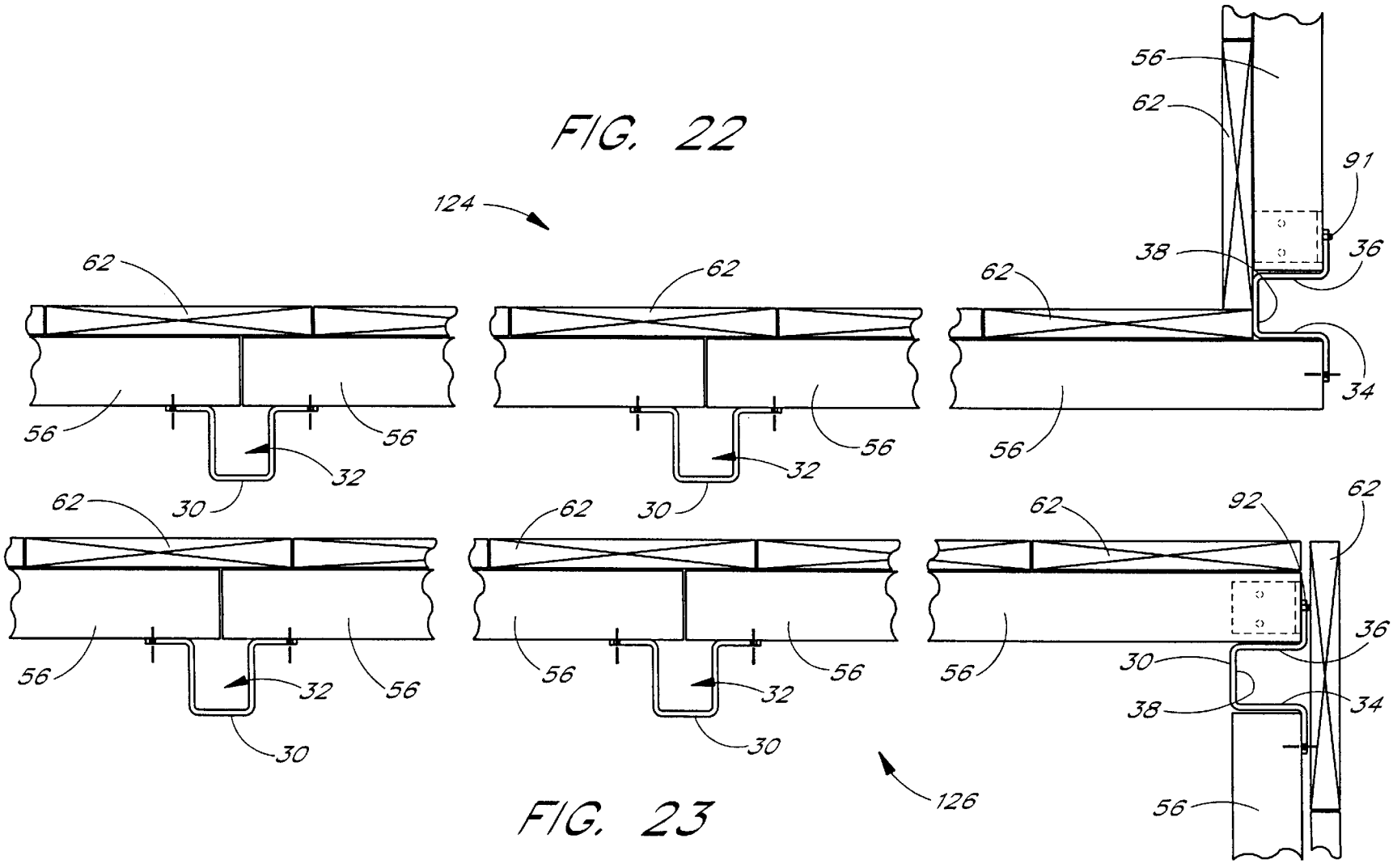
FIG. 22 is a top view of still another fence system using the metal fence post shown in FIG. 3, with portions of the fence system cut away.
FIG. 23 is a top view of another fence system using the metal fence post shown in FIG. 3, with portions of the fence system cut away.

FIG. 22 illustrates still another preferred arrangement of the fence system 124. Instead of mounting the fence posts 30 in-line with the rails 56, the adjacent ends of the rails are positioned near each other or the ends of the rails abut. In this configuration, the U-shaped center section 32 does not contact the rails 56 at all and the fence boards 62 are attached directly to the rails 56. This configuration may be used when only one side of the fence requires a wooden appearance. FIG. 23 illustrates yet another preferred arrangement of the fence system 126. The fence system 126 is generally the same as fence system 124, but a different arrangement of the corner post is shown.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A fence post for an in-line wooden fence wherein standard two-by-four rails supported by flanges extending laterally between two of the posts, with the rails supporting fence boards attached in-line to the rails and flush with the posts, said posts, comprising:

an elongated member including a first end configured to be inserted in the ground and a second end configured to support a wooden fence, the elongated member including a first flange extending along a first edge of the elongated member and a second flange extending along a second edge of the elongated member and generally aligned in the same plane with the first flange, and a generally U-shaped channel positioned between the first flange and the second flange, the channel having a first side connected to the first flange and a second side connected to the second flange, and a rear side joining the first and second sides, and the rear side being spaced rearwardly from the plane of the flanges, the first side and the second side each having a dimension extending between the respective flanges and the rear side approximately the same as the width of a standard two-by-four, whereby the rails may be attached to the flanges, with the ends of the rails being positioned adjacent the respective first and second sides of the channel to thus enable fence boards to cover the flanges and an open end of the channel between the flanges and to also enable fence boards to be attached to the rails adjacent the rear side of the channel.

2. The fence post of claim 1, wherein the rear side includes two or more inwardly extending legs interconnecting the first side and the second side.

3. The fence post of claim 1, wherein the rear side includes an inwardly curved surface interconnecting the first side and the second side.

4. The fence post of claim 1, wherein at least one of the flanges has a plurality of openings extending along one edge.

5. The fence post of claim 4, further including a clip including a body portion and an extension, wherein the extension is configured to be attached to one or more selected openings in one of the flanges.

6. The fence post of claim 5, wherein the clip is configured to attach a top cap to the fence post.

7. The fence post of claim 5, wherein the clip is configured to attach an end cap to the fence post.

8. The fence post of claim 5, wherein the clip is configured to attach a fence rail to the fence post.

9. A fence system, comprising:

a fence post including a front surface defined by a pair of spaced flanges, a generally U-shaped channel having a first side joined to one of the flanges, a second side joined to the other one of the flanges, and a connecting portion interconnecting the first side and the second side, and said connecting portion forming a rear surface of the fence post; and a standard two-by-four rail having a front surface and a rear surface;

wherein the connecting portion is configured to contact and abut the rail with the front surface of the rail engaging and being supported by one of the flanges, such that the front surface of the rail and the front surface of the fence posts are generally aligned, and the rear surface of the rail and the rear surface of the fence post are generally aligned.

10. The fence system of claim 9, further comprising fence boards attached to the front side of the rail.

11. The fence system of claim 9, further comprising fence boards attached to the front side and the rear side of the rail, and wherein the fence post is concealed between two or more of the fence boards.

12. The fence post of claim 9, wherein the fence post is constructed from steel.

13. The fence post of claim 9, further including a clip for attaching wooden members to the fence post, the clip including a body section oriented generally perpendicularly to a foot section, wherein the foot section is configured to be attached to one or more openings in the flanges and the body section is configured to be attached to the wooden members.

14. The fence post of claim 13, further including a tab member connected to the clip, the tab member configured to be inserted into an opening in the fence post.

15. The fence post of claim 14, wherein the tab member is attached to an end of the foot section of the clip.

16. The fence post of claim 14, wherein the tab member is attached to a side of the foot section of the clip.

17. The fence post of claim 13, further comprising two tab members connected to the clip, the tab members configured to attach the clip to the fence post.

18. A method of constructing a fence, comprising:

inserting a fence post into the ground, the fence post including a front surface defined by a pair of spaced flanges a first side joined to one of the flanges and, a second side spaced from the first side and joined to the other one of the flanges, and a rear wall forming a connecting portion interconnecting the first side and the second side, the rear wall being spaced from the front surface and forming a rear surface of the post;

placing one or more fence rails on either side of the fence post so that a front surface of the fence rails is generally aligned with the front surface of the post, and the rear surface of the fence rails is generally aligned with the rear surface of the post;

attaching the one or more fence rails to the flanges of the fence post.

19. The method of claim 18, wherein the fence rail has a width of about 1½ inches.

20. The method of claim 18, wherein the connecting portion has a length of about 1½ inches.

21. The method of claim 18, further comprising attaching fence boards to the fence rails, and wherein the fence boards conceal at least a portion of the fence post.

22. The method of claim 18, further comprising attaching a rail to the fence post by a clip.

23. The method of claim 18, further comprising attaching a top cap to the fence post by a clip.

24. The method of claim 18, further comprising attaching an end cap to the fence post by a clip.

25. The method of claim 18, comprising attaching fence boards in line with both sides of the rails to conceal said post front and rear surfaces.

* * * * *